US008689707B2

(12) United States Patent
Marx et al.

(10) Patent No.: US 8,689,707 B2
(45) Date of Patent: Apr. 8, 2014

(54) ULTRA LOW NOX BURNER REPLACEMENT SYSTEM

(75) Inventors: Peter D. Marx, Hooksett, NH (US); Robert W. Pickering, Concord, NH (US); Charles E. Trippel, Marlborough, CT (US)

(73) Assignee: Fuel Tech, Inc., Warrenville, IL (US)

( * ) Notice: Subject to any disclaimer, the term of this patent is extended or adjusted under 35 U.S.C. 154(b) by 2147 days.

(21) Appl. No.: 11/441,660

(22) Filed: May 26, 2006

(65) Prior Publication Data

US 2007/0272132 A1 Nov. 29, 2007

(51) Int. Cl.
*F23D 1/02* (2006.01)

(52) U.S. Cl.
USPC ..... 110/104 B; 110/261; 110/264; 110/265; 110/341; 431/8; 431/183; 431/188; 431/284

(58) Field of Classification Search
USPC ..... 110/263, 260, 264, 265; 239/466; 431/8, 284, 188, 285, 183
See application file for complete search history.

(56) References Cited

U.S. PATENT DOCUMENTS

| | | | | | |
|---|---|---|---|---|---|
| 3,788,796 | A | * | 1/1974 | Krippene et al. | 110/264 |
| 4,241,673 | A | * | 12/1980 | Smith et al. | 110/264 |
| 4,902,488 | A | | 2/1990 | Epperly et al. | |
| 5,011,400 | A | * | 4/1991 | Vatsky | 431/4 |
| 5,048,431 | A | | 9/1991 | Landreth et al. | |
| 5,131,334 | A | * | 7/1992 | Monro | 110/264 |
| 5,160,380 | A | | 11/1992 | Vocke et al. | |
| 5,231,937 | A | * | 8/1993 | Kobayashi et al. | 110/263 |
| 5,237,393 | A | | 8/1993 | Spokoyny et al. | |
| 5,415,114 | A | * | 5/1995 | Monro et al. | 110/264 |
| 5,415,539 | A | * | 5/1995 | Musil | 431/181 |
| 5,478,542 | A | | 12/1995 | Chawla et al. | |
| 5,536,482 | A | | 7/1996 | Diep et al. | |
| 5,649,494 | A | * | 7/1997 | Hufton | 110/264 |
| 5,681,536 | A | | 10/1997 | Swoboda et al. | |
| 5,697,306 | A | * | 12/1997 | LaRue et al. | 110/261 |
| 5,806,443 | A | * | 9/1998 | Kobayashi et al. | 110/262 |
| 5,823,764 | A | * | 10/1998 | Alberti et al. | 431/184 |
| 5,937,770 | A | * | 8/1999 | Kobayashi et al. | 110/263 |
| 6,152,051 | A | * | 11/2000 | Kiyama et al. | 110/265 |
| 6,237,510 | B1 | * | 5/2001 | Tsumura et al. | 110/263 |
| 6,280,695 | B1 | | 8/2001 | Lissianski et al. | |
| 6,488,466 | B2 | * | 12/2002 | Marx et al. | 415/55.1 |
| 6,524,098 | B1 | * | 2/2003 | Tsirulnikov et al. | 431/9 |
| 6,865,994 | B2 | | 3/2005 | Seeker et al. | |

OTHER PUBLICATIONS

"Burner Replacement Kit: Installation Instructions." Published Nov. 1998 by Nordyne. pp. 1-2.*

* cited by examiner

*Primary Examiner* — Kenneth Rinehart
*Assistant Examiner* — David J Laux
(74) *Attorney, Agent, or Firm* — Thaddius J. Carvis

(57) ABSTRACT

A replacement burner system which facilitates reduction of nitrous oxide produced during combustion of a fuel. The replacement burner system comprising a fuel supply duct having an inlet and an outlet with a fuel deflector located within the fuel supply duct to facilitate redistribution of a flow of the fuel. An adjustable coal nozzle is located within the fuel supply duct between the fuel deflector and the outlet. An exterior surface of the fuel supply duct supports an air swirling device, and the air swirling device obstructs between 65% and 75% of the transverse flow area, located between an exterior surface of the fuel supply duct and the inwardly facing surface of the venturi register, after the replacement burner system is accommodated within the windbox of a combustion boiler. The air swirling device is the only component located in the windbox, between the exterior surface of the fuel supply valve and the inwardly facing surface of the venturi register, for adjusting the flow of the combustion air flowing through the venturi register.

16 Claims, 8 Drawing Sheets

ULTRA LOW NOX BURNER REPLACEMENT SYSTEM

FIELD OF THE INVENTION

The present invention relates to an ultra low $NO_x$ burner replacement system used to replace an existing burner of a combustion boiler.

BACKGROUND OF THE INVENTION

During operation of conventional boilers, normal wear and tear causes the burner, of a conventional combustion boiler, to periodically require servicing or, in some instances, be completely replaced. While a variety of known burner replacement burners and systems are currently available on the market, many of the burner replacement systems are not particularly adapted for reducing the $NO_x$ (nitrogen oxides) byproducts which result from combustion of a fuel, such as coal.

As is well known in the prior art, a reducing agent may be added to the combustion boiler, prior to the combustion byproducts exhausting from the combustion boiler, in order to reduce the amount of $NO_x$ remaining in the exhaust stream as the exhaust stream exits from the combustion boiler. The reducing agent is generally dispersed in the upper region of the combustion boiler and allowed to react with the combustion byproducts prior to the combustion byproducts being exhausted from the combustion boiler. A couple of methods of applying a reducing agent, to the combustion byproducts of a combustion boiler, are disclosed in U.S. Pat. Nos. 4,902,488 and 6,280,695, for example.

As used in the specification and the appending claims, the terms "$NO_x$" and "nitrogen oxides" are used interchangeably to refer to the nitric oxide (NO) and the nitrogen dioxide ($NO_2$) chemical species. Other oxides of nitrogen, such as $N_2O$, $N_2O_3$, $N_2O_4$ and $N_2O_5$, are well known but these species are generally not emitted, in any significant quantities, from stationary combustion sources (except for possible $N_2O$). Thus, while the term "nitrogen oxides" can be used more generally to encompass all binary N—O compounds, it is used herein to refer in particular to the NO and $NO_2$ (e.g., $NO_x$ species).

SUMMARY OF THE INVENTION

Wherefore, it is an object of the present invention to overcome the above mentioned shortcomings and drawbacks associated with the known prior art burner replacements.

Another object of the present invention is to provide an ultra-low $NO_x$ burner replacement system which reduces the amount of nitrogen oxides emitted as byproducts during combustion of a fuel, such as coal.

A further object of the present invention is to provide an ultra-low $NO_x$ burner replacement system in which some of the combustion air, flowing between an exterior surface of the fuel supply duct and the interior surface of the venturi register, flows in a substantially straight or linear flow path to facilitate deep penetration of the combustion air into the combustion boiler and better mixing of the fuel with the combustion air and thereby reduce the amount of nitrogen oxide byproducts produced during combustion.

Yet another object of the present invention is to provide an air swirling device, attached to the exterior surface of the fuel supply duct adjacent the outlet end thereof, which occupies between about 65% to about 75%—typically about 70%—of the transverse cross sectional flow area located within the venturi register but only induces a swirl to between about 30% to about 50% of the secondary combustion air which is flowing between the exterior surface of the fuel supply duct and the inwardly facing surface of the venturi register, to assist with better mixing of the fuel with the combustion air and thereby reduce the amount of nitrogen oxide byproducts produced during combustion.

A still further object of the present invention is to supply the fuel and the combustion air such that the supplied fuel and combustion air have five separate and distinct flow zones, namely, an innermost fuel supply zone supplied in a swirling manner; an outer fuel supply zone, surrounding the innermost fuel supply zone, supplied as a substantially straight or linear flow path or pattern; a first radially innermost combustion air zone, surrounding the outer fuel supply zone, supplied as a substantially straight or linear flow path or pattern; an intermediate combustion air zone, surrounding the first radially innermost combustion air zone, supplied in substantially in a desired swirling flow path or pattern; and an outermost combustion air supply zone, surrounding the intermediate combustion air zone, supplied as a substantially straight or linear flow path or pattern.

The present invention also relates to a replacement burner system which facilitates reduction in an amount of nitrous oxide produced during combustion of a fuel, the replacement burner system comprising: a fuel supply duct having an inlet and an outlet and a bend located between the inlet and the outlet; a fuel deflector located within the fuel supply duct, between the bend and the outlet, to facilitate redistribution of a flow of the fuel; a coal nozzle located within the fuel supply duct between the fuel deflector and the outlet, the coal nozzle facilitates supplying two distinct coal flow zones, and a position of the coal nozzle being adjustable along a length of the fuel supply duct; and an exterior surface of the fuel supply duct supporting an air swirling device, and the air swirling device swirling between about 30% and about 50% of the combustion air flowing between an exterior surface of the fuel supply duct and the inwardly facing surface of the venturi register, after the replacement burner system is accommodated within a windbox of a combustion boiler, and the air swirling device facilitates supplying three distinct air flow zones.

The present invention also relates to a replacement burner system which facilitates reduction in an amount of nitrous oxide produced during combustion of a fuel, the replacement burner system comprising: a fuel supply duct having an inlet and an outlet with a bend located between the inlet and the outlet; a fuel deflector located within the fuel supply duct, between the bend and the outlet, to facilitate redistribution of a flow of the fuel flowing through the fuel supply duct; a coal nozzle located within the fuel supply duct between the fuel deflector and the outlet, and a position of the coal nozzle being adjustable along a length of the fuel supply duct; an exterior surface of the fuel supply duct supporting an air swirling device, and the air swirling device swirling between about 30% and about 50% of the combustion air flowing between an exterior surface of the fuel supply duct and the inwardly facing surface of the venturi register, after the replacement burner system is accommodated within the windbox of a combustion boiler; and only the air swirling device is located in the windbox, between the exterior surface of the fuel supply valve and the inwardly facing surface of the venturi register, to facilitate adjustment of a flow of the combustion air flowing through the venturi register.

BRIEF DESCRIPTION OF THE DRAWINGS

The invention will now be described, by way of example, with reference to the accompanying drawings in which.

DETAILED DESCRIPTION OF THE INVENTION

Figure 1:
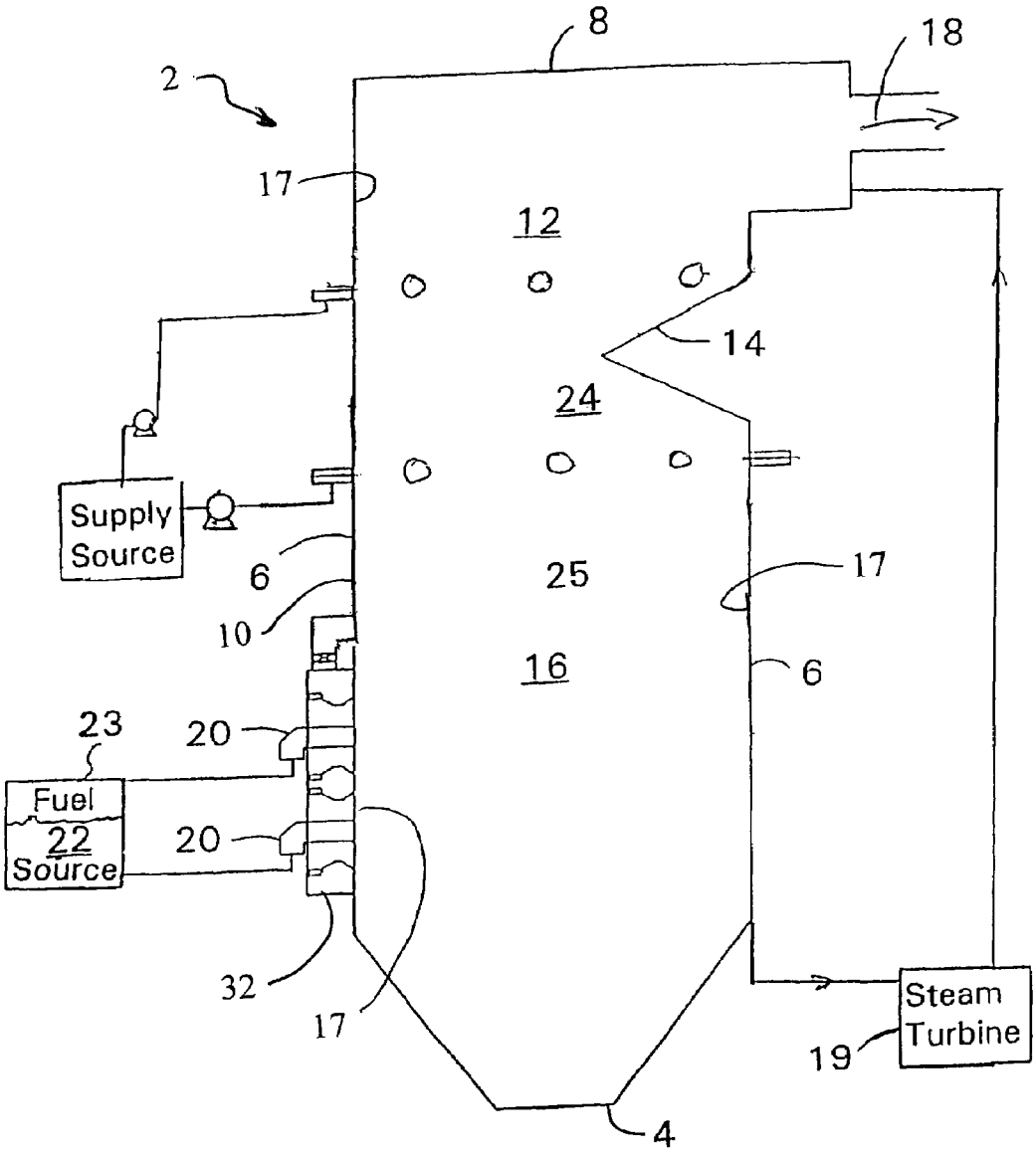
FIG. 1 is a diagrammatic view of a combustion boiler according to the present invention.

Turning now to the FIG. 1, a brief description concerning the general components of a combustion boiler will first be described and this will be followed by a detailed description of the present invention. As can be seen in FIG. 1, the combustion boiler is generally designated with reference numeral number 2. The combustion boiler 2 includes a base wall 4 and a sidewall 6, e.g., generally four sidewalls, as well as a top wall 8. The base wall 4, the four sidewalls 6 and the top wall 8 define an enclosed area or exterior housing 10 which forms the combustion boiler 2. An inwardly tapering indentation 14 is formed in the rear sidewall 6 of the housing 10 and this inwardly tapering indentation 14 forms a constriction or a throat in the combustion boiler 2 that accelerates the combustion byproducts as they flow from a vertically lower primary combustion chamber 16 into a vertically higher secondary combustion chamber 12. Finally, an exit section 18 is formed in one of the sidewalls 6 of the combustion boiler 2, above the inwardly tapering indentation 14 and adjacent the top wall 8. The exit section 18 generally facilitates exhausting of the combustion byproducts from the combustion boiler 2 to a further treatment apparatus or system, as is well known in the art, prior to discharging such combustion byproducts into the atmosphere. Since the further treating of the combustion byproducts, prior to discharging the same into the atmosphere, is well known in the art and forms no part of the present invention per se, a further detail discussion concerning the same is not provided.

As is conventional in the art, each one of the sidewalls 6 of the combustion boiler 2 includes an internal array of a plurality of longitudinally arranged parallel conduits or tubes 17 (not shown in detail) which typically define the inner surface or wall of the combustion boiler 2 and facilitate the flow of a cooling fluid, e.g., a cooling water, through the conduits or tubes 17 to remove heat therefrom. The plurality of longitudinally arranged parallel conduits or tubes 17 generally extend from adjacent the top wall 8 to adjacent the base wall 4. The cooling fluid is supplied to one or more inlet(s), coupled to the plurality of longitudinally arranged parallel conduits or tubes 17, and flows therethrough to absorb and remove heat generated within the primary and secondary combustion chambers 16, 12 and absorbed by the conduits or tubes of the combustion boiler 2. The heated fluid is then discharged, via a cooling fluid outlet(s) coupled thereto, and this heat fluid is typically used to drive a steam turbine 19 (only diagrammatically shown in FIG. 1), for example, which, in turn, is used to generate electricity in a conventional manner. Alternatively, the heated fluid is also sometimes used as steam in an industrial process.

As is conventional in the art, one or more burner openings 25 is formed in the longitudinally arranged parallel conduits or tubes 17, and each burner opening 25 communicates with a fuel supply duct 20 which supplies a desired fuel 22, e.g., finely ground coal, oil, gas, etc., from a fuel supply source 23 and a venturi register 44 which supplies an ample supply of oxygen to the combustion boiler 2. To achieve formation of the burner openings in the parallel conduits or tubes 17, the conduits or tubes 17 are generally bent or contoured outwardly toward the exterior housing 10 of the combustion boiler 2 so as to define the burner opening 25 which is typically a funnel-shaped throat 21. The exposed surface of the funnel-shaped throat 21, facing the interior of the combustion boiler 2, is typically covered with a protective refractory material so as to prevent damage to the portion of the conduits or tubes 17, forming the funnel-shaped throat 21, during combustion of the fuel. As the above aspects of the combustion boiler 2 are conventional and well known in the art, a further detailed description concerning the same is not provided.

As shown in FIG. 1, two rows of fuel supply duct(s) 20 may be utilized for supplying fuel 22 to the combustion boiler 2. The supplied fuel 22 is discharged via an outlet 28 of each one of the fuel supply duct(s) 20 into a combustion chamber of the combustion boiler 2 typically toward a front side of a lower region of the primary combustion chamber 16, where the discharged fuel 22 ignites and is rapidly consumed. Generally, a high level of nitrogen oxides are generated as the fuel 22 is consumed and such nitrogen oxides have a tendency to collect adjacent the rear surface of the combustion boiler 2.

Alternatively, one or more rows of fuel supply duct(s) 20 may be provided along an opposed sidewall 6 so that the supplied fuel 22 from the opposed and facing fuel supply ducts 20 intermix with one another in a central region or area of the primary combustion chamber 16. This arrangement generally results in a higher level of nitrogen oxides in the central region or area of the combustion boiler 2.

The combustion boiler 2 typically operates at very high temperatures, e.g., between 2,800° and 3,300° F., and, as a result of such high temperatures, the fuel 22 is substantially instantaneously consumed as soon as the fuel 22 enters into the primary combustion chamber 16 of the combustion boiler 2. The combustion byproducts resulting from combustion of the fuel 22, due to their elevated temperature, flow rapidly upward through the interior of the combustion boiler 2 toward the exit section 18.

As discussed above, the combustion byproducts resulting from the combustion of the fuel 22 generates nitrogen oxides which are harmful to the environment and must be eliminated, as much as possible, prior to exhausting the combustion byproducts into the atmosphere. Carbon monoxide may also be generated as a byproduct. To facilitate a reduction and/or conversion of the nitrogen oxides, which are generated during combustion, into relatively harmless compositions (such as $N_2$ and $H_2O$, for example), a reducing agent is sometimes supplied to the combustion boiler 2. The reducing agent reduces the nitrogen oxides to $N_2$ and $H_2O$, and suitable reducing agents are, for example, ammonia, ammonia salts, urea and urea prills. Since the combustion boiler 2 and its combustion process are well known in the art and forms no part of the present invention per se, a further detail discussion concerning the same is not provided.

Figure 2:
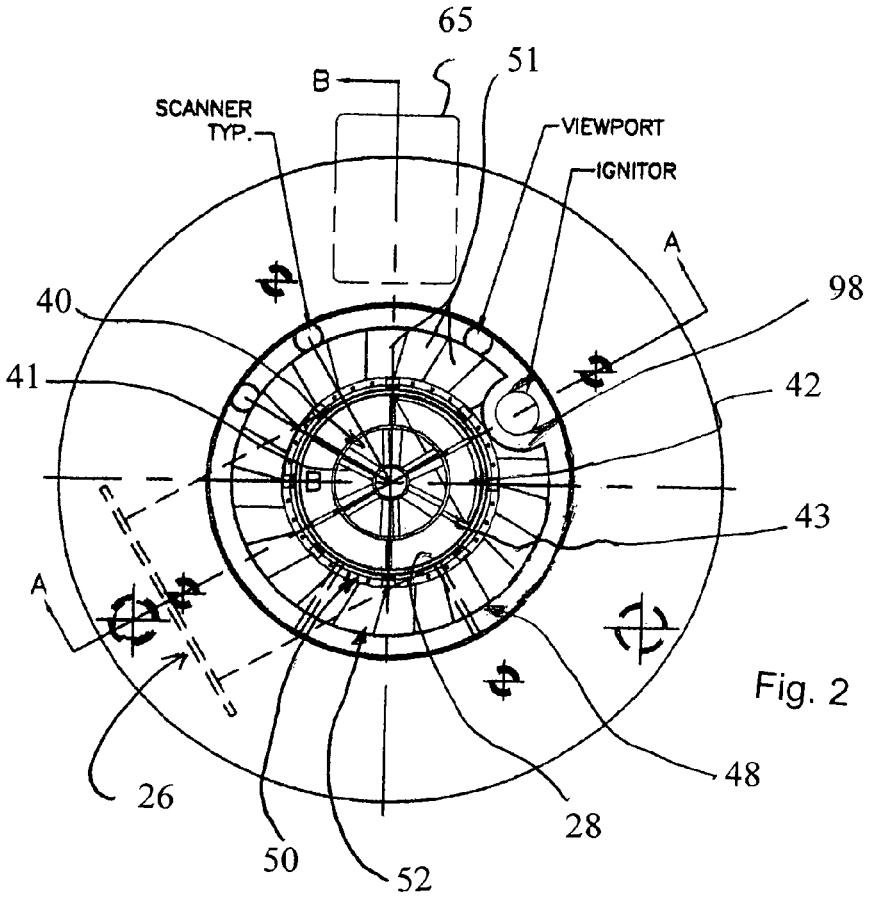
FIG. 2 is a diagrammatic left side end view of the ultra low $NO_x$ burner replacement system shown installed in a windbox of combustion boiler.
Figure 2C:
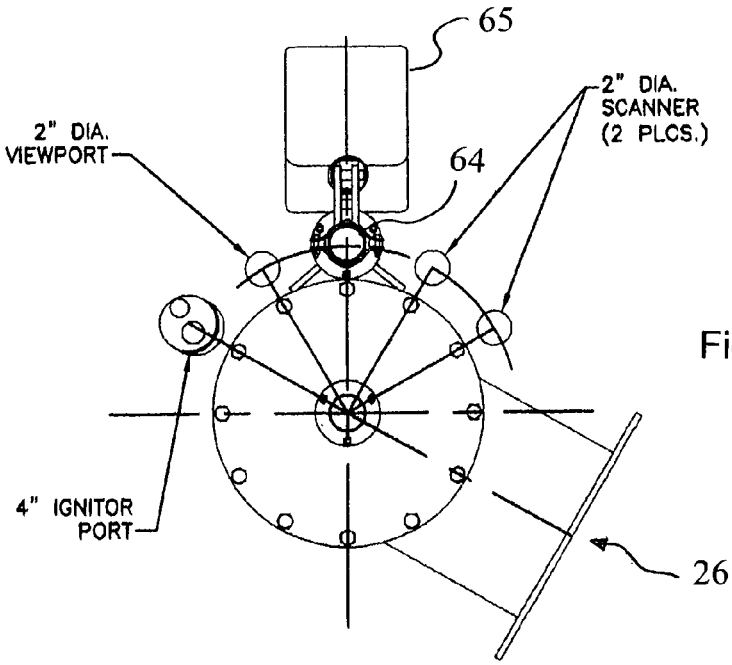
FIG. 2C is a diagrammatic right side end view of the ultra low $NO_x$ burner replacement system of FIG. 2 shown installed in a windbox of combustion boiler.

With reference now to FIGS. 2-2C, a detailed description concerning a "plug-in" ultra low $NO_x$ replacement burner system 15, according to the present invention, for reducing the amount of nitrogen oxide produced as combustion byproducts, during combustion, will now be described. The ultra low $NO_x$ burner comprises a generally cylindrical shaped fuel supply duct 20 which has an duct inlet 26, for connection in a conventional manner to a source of fuel 22, such as ground coal, supplied in a convention manner by a fuel supply source 23, and a duct outlet 28 which is located to directly communicate with and discharge source of fuel 22 via the funnel-shaped throat 21 into the interior of the conventional combustion boiler 2. The fuel supply duct 20 extends through an opening in a windbox cover or front plate 27 and is fixedly supported thereby once the front plate 27 is affixed to the exterior housing 10 of the combustion boiler 2, e.g., by a plurality of fastening bolts.

A 90 degree transition, bend or elbow 30 is typically provided in the fuel supply duct 20, between the duct inlet 26 and the duct outlet 28, for redirecting the supplied fuel 22 directly through a center of the windbox 32 into the interior lower region of the primary combustion chamber 16 of the combustion boiler 2. This 90 degree transition, bend or elbow 30 is typically located between the duct inlet 26 and the duct outlet 28 of the fuel supply duct 20 but may be located somewhat closer to the duct inlet 26.

A fuel deflector 34 is provided within the fuel supply duct 20 soon after or following the 90 degree transition, bend or elbow 30, e.g., between the duct outlet 28 and the 90 degree transition, bend or elbow 30. The fuel deflector 34 is positioned along the interior surface of the fuel supply duct 20, directly after the 90 degree transition, bend or elbow 30, to facilitate redirecting and/or redistribution of the fuel 22 as soon as such fuel 22 exits from the 90 degree transition, bend or elbow 30. That is, the fuel 22 has a normal tendency to abut against and thereafter remain and flow primarily along and adjacent the largest radius of curvature or path of travel of the 90 degree transition, bend or elbow 30 as the fuel 22 exits from the 90 degree transition, bend or elbow 30. The fuel deflector 34 is positioned to force, redirect and/or redistribute the fuel 22 back toward the center and opposite side wall of the fuel supply duct 20 and thereby result in a substantially more uniform distribution of the fuel 22, across the transverse cross sectional area of the fuel supply duct 20, as the fuel 22 is supplied along the fuel supply duct 20 from the 90 degree transition, bend or elbow 30 to the duct outlet 28.

As shown in FIGS. 2, 2A, 2B and 4, a coal nozzle 36 is accommodated inside the supply duct 20 at a located between the fuel deflector 34 and the duct outlet 28 of the fuel supply duct 20, and the coal nozzle 36 is typically located adjacent the duct outlet 28. The coal nozzle 36 lies or extends substantially perpendicular to the travel or flow direction of the fuel 22, as the fuel 22 flows along the interior of the fuel supply duct 20, to facilitate reorienting, redirecting and/or redistribution of the fuel 22 in a desired fuel configuration immediately prior to the fuel 22 being discharged or exhausted from fuel supply duct 20. The coal nozzle 36 is connected to one end of a centrally located flame regulation rod 38. The opposite end of the flame regulation rod 38 extends though the front plate 27 and is connected to a flame adjuster device 39 so as to facilitate sliding to and fro adjustment of the position of the coal nozzle 36, relative to the outlet 28 of the fuel supply duct 20, and thereby facilitate adjustment of the overall size and overall shape of the flame consuming the fuel 22 as the fuel 22 exits or exhausts from the outlet 28 of the fuel supply duct 20 and enters the combustion boiler 2.

Figure 2A:
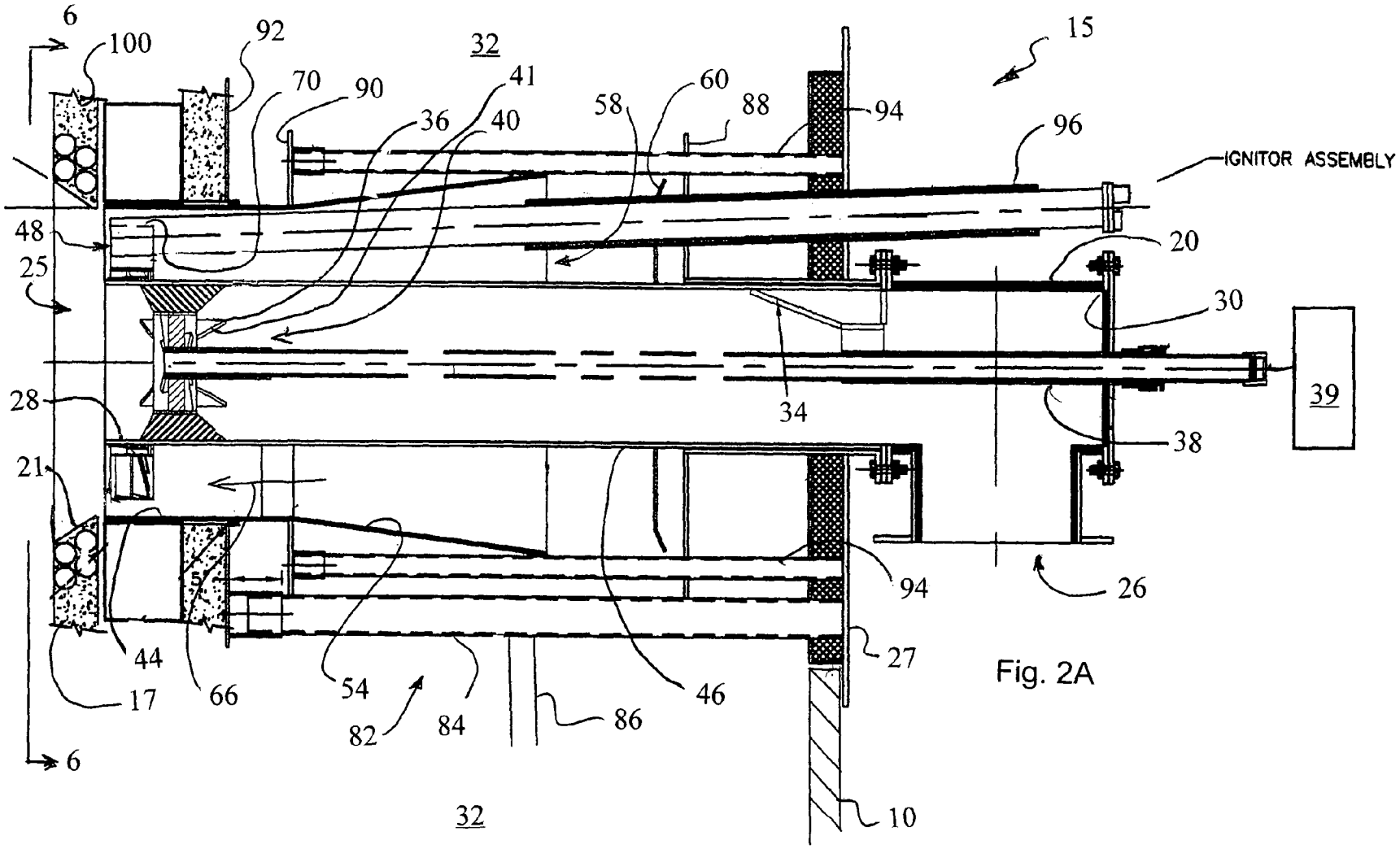
FIG. 2A is a diagrammatic cross sectional view of the burner replacement system of FIG. 2 along section line 2A-2A of FIG. 2.
Figure 2B:
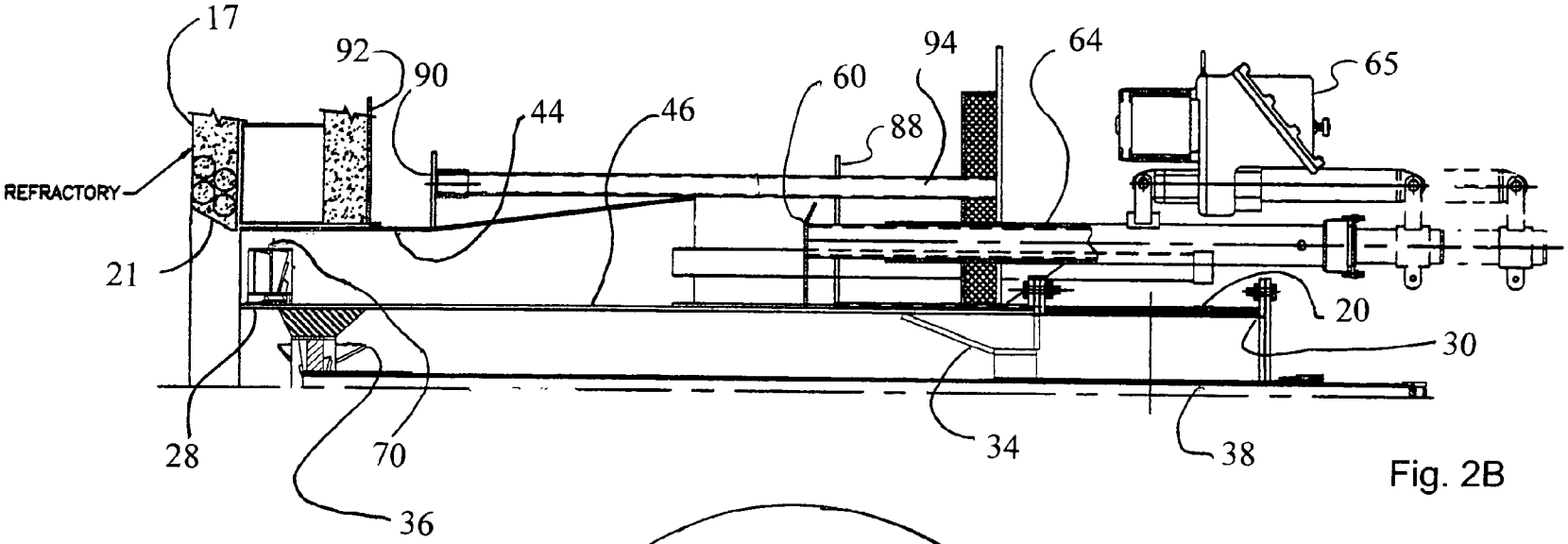
FIG. 2B is a diagrammatic cross sectional view of the burner replacement system of FIG. 2 along section line 2B-2B of FIG. 2.
Figure 7:
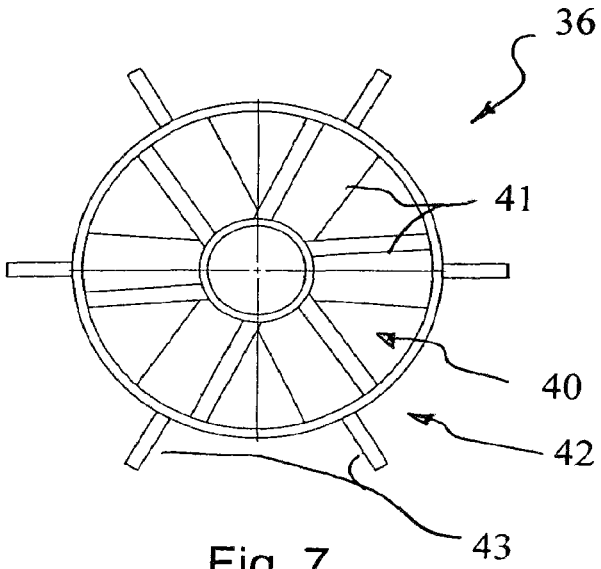
FIG. 7 is a diagrammatic front elevational view showing the two regions of the coal nozzle.

The coal nozzle 36 generally comprises two concentric regions (see FIGS. 2, 2A and 7), a radially innermost central region 40 which is designed to induce a desired swirling motion or flow to the fuel 22, such as ground coal, immediately prior to the fuel 22 being discharged via the duct outlet 28 of the fuel supply duct 20. A plurality of inner coal blades or fins 41, e.g., six of which are shown in FIGS. 2, 2A and 7 of the drawings, for inducing the desired swirling motion or flow to the fuel 22, are oriented or arranged so as to form an angle of between about 20 to about 40 degrees or so relative to the travel path of the fuel within fuel supply duct 20. The coal nozzle 36 also includes a radially outermost peripheral region 42 which has a number of outer coal blades or fins 43, e.g., six of which are shown in FIGS. 2 and 7 of the drawings, arranged and designed to supply a portion of the supplied fuel 22 in a substantially straight or linear flow pattern or path. As will be appreciated by those skilled in the art, the number and the spacing of the inner and outer coal blades or fins 41, 43 can vary depending upon the particular application at hand.

The innermost swirl region 40 of the coal nozzle 36 generally comprises about 25 to about 40% of the transverse cross sectional surface area of the coal nozzle 36 while the outermost region 42 of the coal nozzle 36 generally comprises about 60 to about 75% of the transverse cross sectional surface area of the coal nozzle 36. The coal nozzle 36 thereby redirects and redistributes the fuel 22 into two distinct fuel flow streams, namely, the inner most fuel flow stream which has a desired swelling flow pattern and the outer most fuel flow stream which has a substantially straight or linear flow path or pattern which surrounds and encases the inner most fuel flow stream.

As is common in this art, a conventional windbox 32 is formed along the lower portion of the front and/or rear sidewalls 6, between the lower portion of the longitudinally arranged parallel conduits or tubes 17 and the exterior housing 10 of the combustion boiler 2. The windbox 32 facilitates the supply of combustion air 66, via a one or more large intake fans (not shown) to the venturi register 44.

Figure 4:
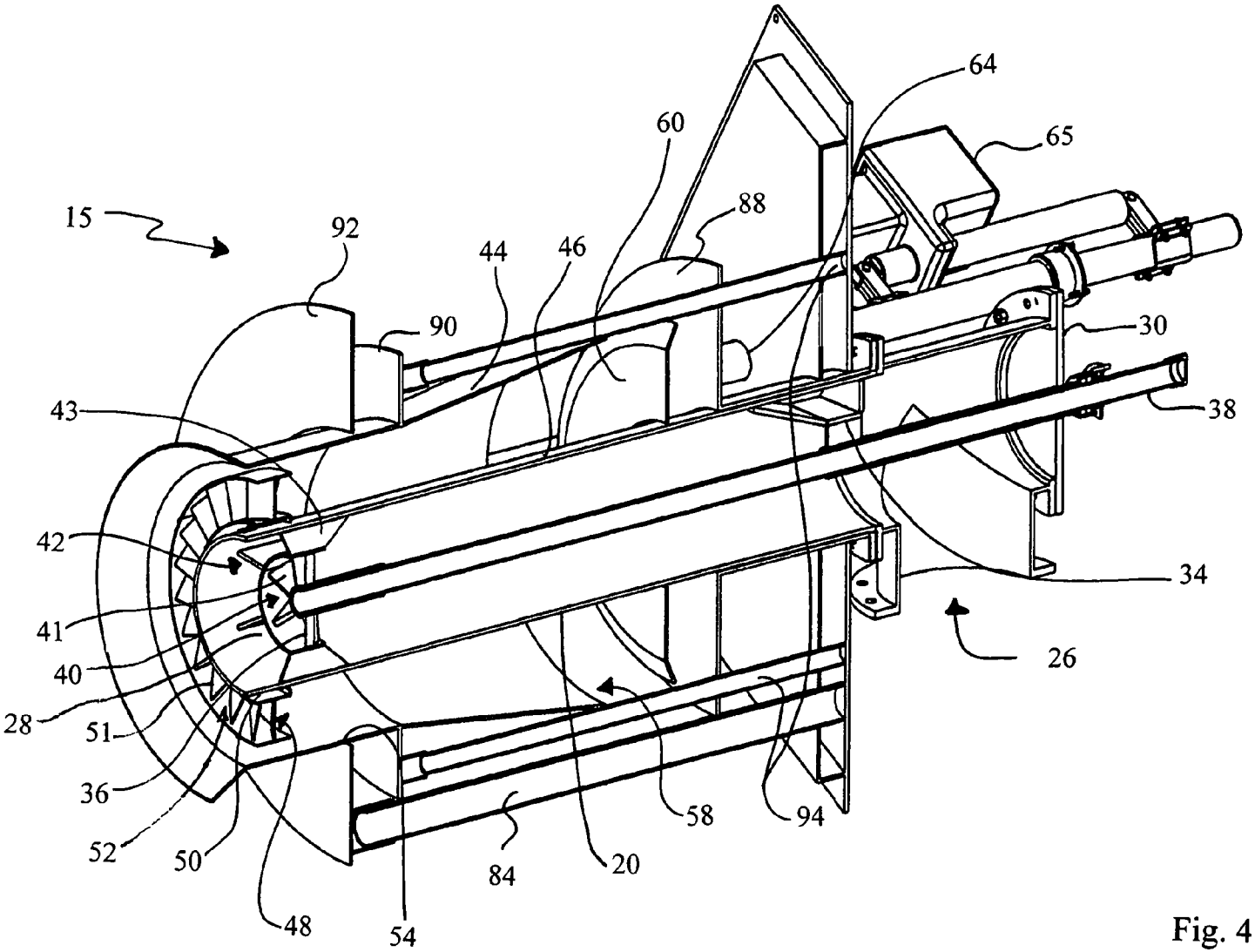
FIG. 4 is a diagrammatic cross sectional view of the burner replacement system of FIG. 3 along section line 4-4 of FIG. 3.
Figure 5:
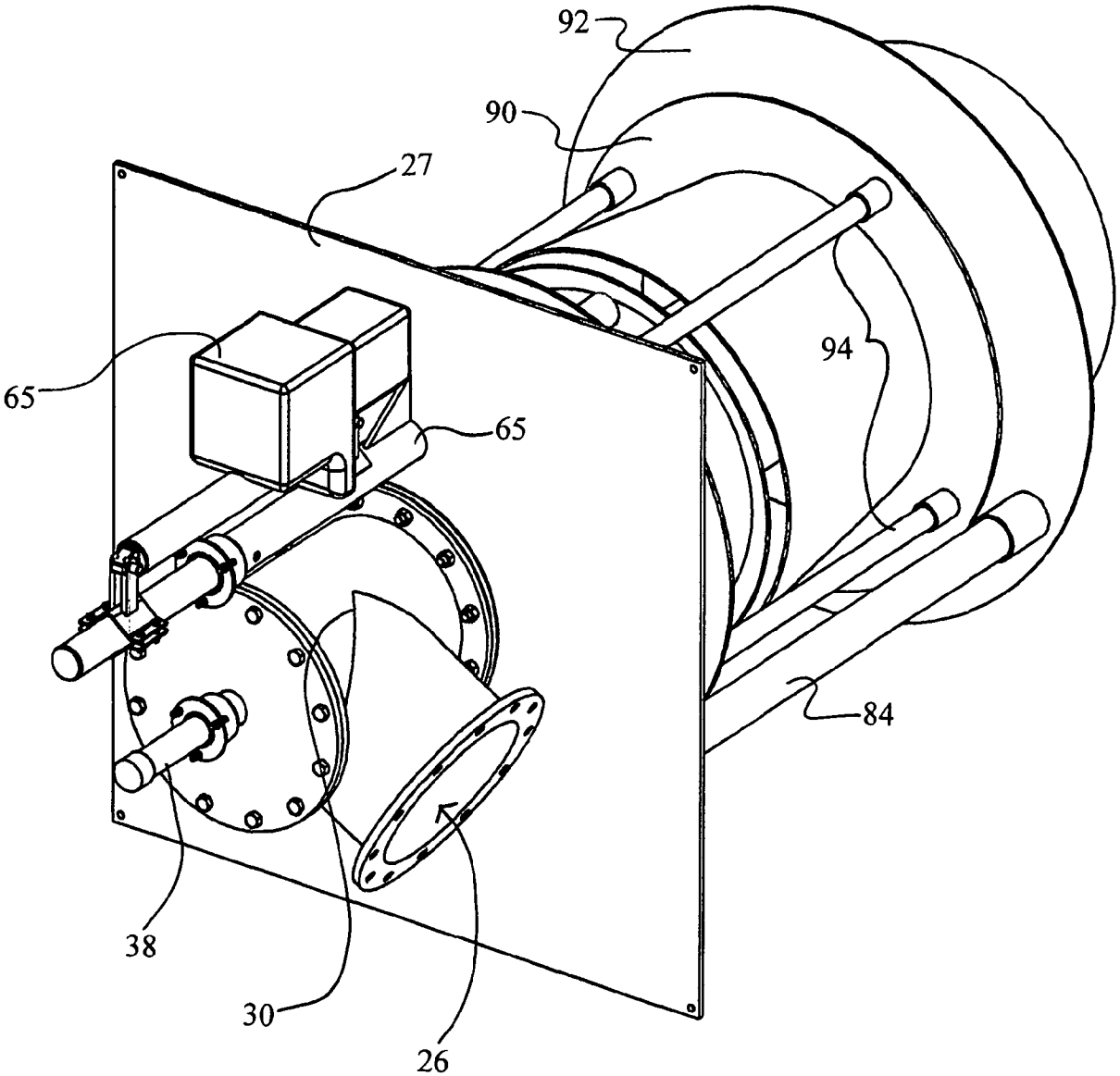
FIG. 5 is a diagrammatic rear perspective view of the burner replacement system of FIG. 3.
Figure 8:
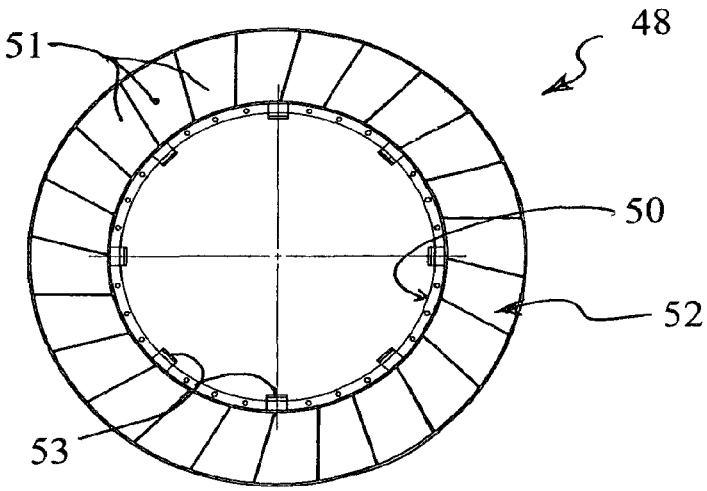
FIG. 8 is a diagrammatic front elevational view showing the three sections of the air swirling device.

A substantially cylindrical venturi register 44 is located within the windbox 32 of the combustion boiler 2 concentrically with respect to the exterior surface 46 of the fuel supply duct 20. As shown in FIGS. 2, 2A and 4, an air swirling device 48 is supported by the exterior surface 46 of the fuel supply duct 20, at or adjacent the discharge end thereof, to facilitate swirling of the combustion air 66 as the combustion air flows through the venturi register 44 and enters the combustion boiler 2. Typically, the air swirling device 48 is located between about an inch or two or so away from the edge or end of outlet 28 of the fuel supply duct 20. The air swirling device 48 typically has two radially arranged sections (see FIGS. 2, 2A and 8), namely, a radially innermost vane section 50 has axial vanes 53, e.g., eight axial vanes, which are designed to supply combustion air 66 in a substantially straight or linear flow path or pattern and a radially outer perimeter vane section 52, located concentrically with respect to the radially innermost vane section 50, which is designed to induce a desired swirling flow path or pattern of the combustion air 66 immediately prior to the combustion air 66 being discharged into the combustion boiler 2. The radially innermost vane section 50 obstructs about 5% to 10% of the transverse cross sectional flow area while the radially outer perimeter vane section 52 of the air swirling device 48 obstructs about 55% to about 70% of the transverse cross sectional flow area of the venturi register 44. The air blades or fins 51 for inducing the desired swirling motion or flow to the combustion air 66, e.g., twenty four of which are shown in FIGS. 2 and 8 of the drawings, are oriented or arranged so as to form an angle of between about 45 to about 65 degrees or so relative to the travel or flow path of the combustion air 66 within the venturi register 44.

One aspect of the present invention is that the of the air swirling device 48, attached to the exterior surface of the fuel supply duct 20 adjacent the outlet end thereof, which obstructs or occupies between about 65% to about 75%—typically about 70%—of the transverse cross sectional flow area within the venturi register 44 but only induces a swirl to between about 30% to about 50%—typically about 40%—percent of the burner secondary air flow which is flowing between the exterior surface 46 of the fuel supply duct 20 and the inwardly facing surface 54 of the venturi register 44.

An inlet 58 of the venturi register 44 communicates with the windbox 32 so as to facilitate supplying combustion air 66 to interior of the combustion boiler 2 to aid in combustion of the supplied fuel 22. A combustion air supply disk 60 generally surrounds and is suitably sealed, in a conventional manner, with respect to the exterior surface 46 of the fuel supply duct 20. The combustion air supply disk 60 is typically located adjacent the 90 degree transition, bend or elbow 30 of the fuel supply duct 20 but spaced inwardly from the exterior housing 10 of the combustion boiler 2. A first end of one or more flow control rods 64 is/are connected to the combustion air supply disk 60 while an opposite end thereof is connected to an actuator 65, e.g., a Jordan actuator, to facilitate adjustment of the spacing of the combustion air supply disk 60 from the inlet 58 of the venturi register 44 and thereby facilitate control of the amount or the volume of the combustion air 66 that is allowed to pass between the combustion air supply disk 60 and the end surface of the venturi register 44 defining the register inlet 58 and enter the venturi register 44 and flow therealong into the combustion boiler 2 where the combustion air 66 mixes or combines with the supplied fuel 22 to facilitate combustion thereof.

Figure 6:
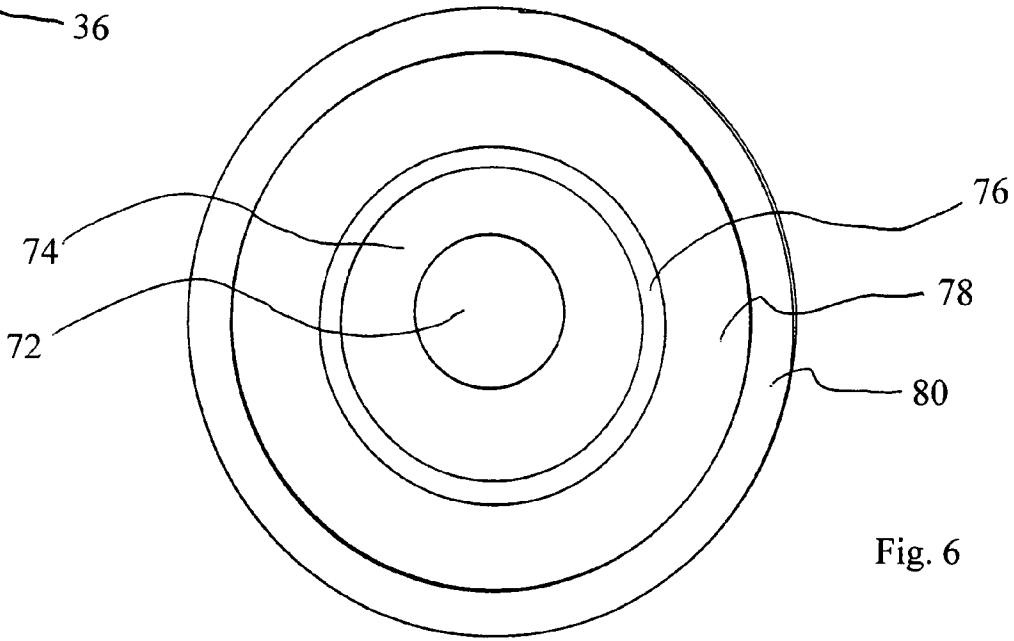
FIG. 6 is a diagrammatic sectional view, along section line 6-6 of FIG. 2A, showing the five separate and distinct flow patterns for the fuel and the combustion air immediately prior to discharge into the combustion boiler.
Figure 3:
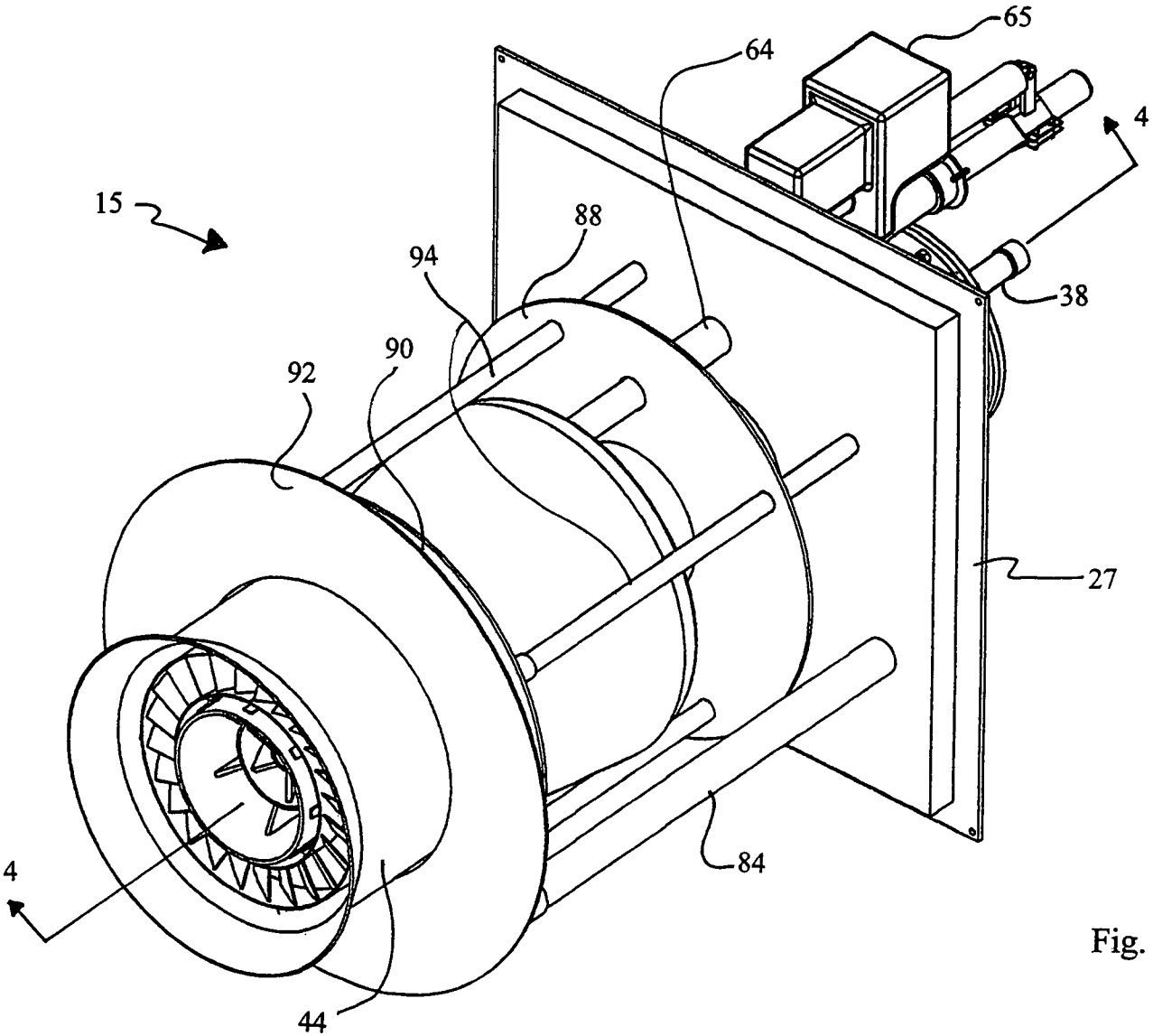
FIG. 3 is a diagrammatic front perspective view of the burner replacement system of the invention.

The radially outermost combustion air 66 which flows through the venturi register 44, between the outer perimeter peripheral edge 70 of the air swirling device 48 and inwardly facing surface 54 of the venturi register 44, flows through register 44 in a substantially straight or linear flow path or pattern. The overall net result is that the replacement burner system 15, according to the present invention, results in an arrangement in which there are five concentric and distinct flow paths or patterns (see FIG. 6), namely, two innermost concentric and distinct flow paths or patterns for the fuel and three outer most concentric and distinct flow paths or patterns for the air. That is, an innermost fuel supply zone 72 is supplied in a swirling manner; an outer fuel supply zone 74, concentric with and surrounding the innermost fuel supply zone 72, is supplied as a substantially straight or linear flow path or pattern; a first radially innermost combustion air zone 76, concentric with and surrounding the outer fuel supply zone 74, is supplied as a substantially straight or linear flow path or pattern; an intermediate combustion air zone 78, concentric with and surrounding the first radially innermost combustion air zone 76, is supplied substantially in a desired swirling flow path or pattern; and an outermost combustion air supply zone 80, concentric with and surrounding the intermediate combustion air zone 78, is supplied as a substantially straight or linear flow path or pattern. These five flow patterns assist with and facilitate more intimate mixing of the supplied fuel 22 with the supplied combustion air 66 and a deeper penetration of the air/fuel mixture into the combustion boiler and thereby results in an adequate supply of combustion air 66, e.g., oxygen, to the combustion boiler 2 for reacting with the supplied fuel 22, during combustion thereof, which thereby reduces the amount of harmful nitrogen oxides produced during combustion.

The inventors have found that it is desirable to remove any existing vanes or air register, which are conventionally located within the venturi register 44 so that the combustion air 66 which flows through the venturi register 44, of the combustion burner replacement system 15 according to the present invention, achieves the desired linear/swirl flow paths or patterns of the combustion air 66 and thereby results in a combustion burner replacement system 15 which generates a reduced amount, e.g., an ultra-low amount, of $NO_x$ during combustion.

As can be seen in FIGS. 2-5 of the drawings, the front plate 27 supports a framework 82 which provides rigidity and support for the various components of replacement burner system 15. The framework 82 comprises at least one base frame member 84 which is connected to the front plate 27 and extends perpendicular thereto into the windbox 32 for supporting the fuel supply duct 20 and the venturi register 44. The base frame member 84 is typically supported by or on a portion of the existing residual burner support 86 (only diagrammatically shown) which is located within the windbox 32. The frame member 84 may be tack welded or otherwise secured to the existing residual burner support 86 to facilitate permanent retention thereof but facilitates replacement of the burner, when necessary. The framework 82 also includes a plurality of vertical frame supports 88, 90 and 92 which each extends substantially parallel to the front plate 27, but are spaced therefrom, to provide support and rigidity for the end of the fuel supply duct 20 remote from the front plate 27 and for the venturi register 44. A plurality of additional frame members 94, e.g., three or four members, are supported by the front plate 27 and extend perpendicular thereto into the windbox 32 and support the first two vertical frame supports 88 and 90 and add additional rigidity and support for the fuel supply duct 20 and the venturi register 44. It is to be appreciated that the overall shape and configuration of the framework 82 will be dictated by the existing space within the windbox 32 and the existing residual burner support 86. But in most instances, the replacement burner system 15 will have essentially the same basic components.

In order facilitate ignition of fuel within the combustion boiler 2 during start-up, a retractable igniter 96 is typically located between the exterior surface 46 of the fuel supply duct 20 and the inwardly facing surface 54 of the venturi register 44, the air swirling device 48 is typically provided with a notched or cutout section 98 which allows the igniter 96 to move forward and protrude through the notched or cutout section 98, the air swirling device 48, and partially into the throat 21 so as to facilitate ignition of the fuel 22 exhausting from the duct outlet 28 during initiation of combustion in the combustion boiler 2. Once combustion of the fuel 22 is self sustaining, the igniter 96 is shut off and retracted away from the throat 21. The combustion air 66, flowing through the venturi register 44, adequate cools the igniter 96 and prevents damage thereto during operation of the combustion boiler 2.

To ensure all of the combustion air 66 is supplied via venturi register 44, a refractive material 100 typically seals any gap(s) or opening(s) between the perimeter edge of the outlet of the venturi register 44 and the adjacent surface of the throat 21 leading into the combustion boiler 2.

It will be appreciated that since the replacement burner system 15, including the associated framework 82, can be easily removed by merely unbolting the front plate 27 from the exterior housing 10 of the combustion boiler 2, and removing the entire replacement burner system 15 out through the opening, replacement of the burner system is expedited. As such, the replacement burner system 15, according to the present invention, improves the speed and reliability of replacing a spent or damaged burner with a new ultra low $NO_x$ replacement burner system 15.

Since certain changes may be made in the above described improved ultra low $NO_x$ burner system, without departing from the spirit and scope of the invention herein involved, it is intended that all of the subject matter of the above description or shown in the accompanying drawings shall be interpreted merely as examples illustrating the inventive concept herein and shall not be construed as limiting the invention.

We claim:

1. A replacement burner system which facilitates reduction in an amount of nitrous oxide produced during combustion of a fuel, the replacement burner system capable of providing five concentric and distinct flow paths for fuel and combustion air, comprising:

a fuel supply duct having an inlet and an outlet and a bend located between the inlet and the outlet;

a fuel deflector located within the fuel supply duct, between the bend and the outlet, to facilitate redistribution of a flow of the fuel;

a coal nozzle located within the fuel supply duct between the fuel deflector and the outlet, and a position of the coal nozzle being adjustable along a length of the fuel supply duct, wherein the coal nozzle comprises an innermost central zone which induces a swirling flow pattern of the fuel as the fuel flows therethrough and a radially outermost peripheral zone which facilitates supply of the fuel in a substantially linear flow pattern in an outer fuel zone concentric with and surrounding the central zone;

an exterior surface of the fuel supply duct supporting an air swirling device, and the air swirling device occupying between about 65% to about 75% of the transverse cross sectional flow area, located between an exterior surface of the fuel supply duct and the inwardly facing surface of a venturi register, after the replacement burner system is accommodated within a windbox of a combustion boiler;

wherein the air swirling device is located between an exterior surface of the fuel supply duct and the inwardly facing surface of the venturi register, and comprises a first radially innermost combustion air zone, concentric with and surrounding the exterior surface of the fuel supply duct to supply air with a substantially linear flow pattern; and an intermediate combustion air zone, concentric with and surrounding the first radially innermost combustion air zone to supply air substantially in a swirling flow pattern, and a radially outermost combustion air zone to supply air in a linear flow pattern zone concentric with and surrounding the intermediate combustion air zone.

2. The replacement burner system according to claim 1, wherein a flame regulation rod is connected to the coal nozzle to facilitate sliding adjustment of the position of the coal nozzle relative to the fuel supply duct and facilitate adjustment of at least one of a shape and a size of a flame consuming the fuel within the combustion boiler.

3. The replacement burner system according to claim 1, wherein the innermost swirl region of the coal nozzle generally comprises about 25 to about 40% of a transverse cross sectional surface area of the coal nozzle while the outermost region of the coal nozzle generally comprises about 60 to about 75% of the transverse cross sectional surface area of the coal nozzle.

4. The replacement burner system according to claim 1, wherein the air swirling device has a radially innermost vane section which supplies combustion air in a substantially linear flow path and a radially outer perimeter vane section which induces a desired swirling flow path of the combustion air as the combustion air flow therethrough.

5. The replacement burner system according to claim 4, wherein the radially innermost vane section of the air swirling device obstructs about 5 to 10% of the transverse cross sectional flow area while the radially outer perimeter vane section of the air swirling device obstructs about 55% to about 70% of the transverse cross sectional flow area; and innermost vane section of the air swirling redirects in a linear flow pattern about 5% of the combustion air flow.

6. The replacement burner system according to claim 1, wherein a combustion air supply duct communicates with the venturi register and the combustion air supply duct includes a combustion air supply disk which is coupled to at least one control rod to control a spacing of the air supply disk relative an inlet of the venturi register and such relative spacing controls a volume of combustion air which is permitted to pass there between and enter the combustion boiler.

7. The replacement burner system according to claim 6, wherein at least one airflow control rod is connected to the combustion air supply disk to facilitate controlling an amount of combustion air that is permitted to flow through the venturi register into the combustion boiler.

8. The replacement burner system according to claim 1, wherein the fuel deflector is located within the fuel supply duct between the bend and the coal nozzle.

9. The replacement burner system according to claim 1, wherein the coal nozzle comprises an innermost central region which induces a desired swirling flow path of the fuel as the fuel flows therethrough, and a radially outermost peripheral region which facilitates supply of the fuel in a substantially linear flow path; and the air swirling device has a radially innermost vane section which supplies combustion air in a substantially linear flow path and a radially outer perimeter vane section which induces a desired swirling flow path of the combustion air as the combustion air flow therethrough.

10. The replacement burner system according to claim 9, wherein the innermost central region comprises a plurality of coal blades which form an angle of between about 20 to about 40 degrees relative to the flow path of the combustion air within the venturi register to induce the desired swirling flow path to the combustion air.

11. The replacement burner system according to claim 9, wherein the outer perimeter vane section comprises a plurality of air blades which form an angle of between about 45 to about 65 degrees relative to the flow path of the combustion air within the venturi register to induce the desired swirling flow path to the combustion air.

12. The replacement burner system according to claim 1, wherein the replacement burner system includes a retractable igniter to facilitate ignition of the replacement burner system during start up of the combustion boiler, and the igniter is located between an exterior surface of the fuel supply duct and the inwardly facing surface of the venturi register.

13. A replacement burner system according to claim 1 which facilitates reduction in an amount of nitrous oxide produced during combustion of a fuel, wherein only the air swirling device is located in the windbox, between the exterior surface of a fuel supply valve and the inwardly facing surface of a the venturi register, to facilitate adjustment of a flow of the combustion air flowing through the venturi register.

14. The replacement burner system according to claim 13, wherein a flame regulation rod is connected to the coal nozzle to facilitate sliding adjustment of the position of the coal nozzle relative to the fuel supply duct and facilitate adjustment of at least one of a shape and a size of a flame consuming the fuel.

15. The replacement burner system according to claim 1, wherein the coal nozzle comprises an innermost central region which induces a desired swirling flow path of the fuel as the fuel flows therethrough, and a radially outermost peripheral region which facilitates supply of the fuel in a substantially linear flow path; the air swirling device has a radially innermost vane section which supplies combustion air in a substantially linear flow path and a radially outer perimeter vane section which induces a desired swirling flow path of the combustion air as the combustion air flow therethrough; the innermost central region comprises a plurality of coal blades which form an angle of between about 20 to about 40 degrees relative to the flow path of the combustion air within the venturi register to induce the desired swirling flow path to the combustion air; and the outer perimeter vane section comprises a plurality of air blades which form an angle of between about 45 to about 65 degrees relative to the flow path of the combustion air within the venturi register to induce the desired swirling flow path to the combustion air.

16. A method of replacing an old burner with a replacement burner system which facilitates reduction in an amount of nitrous oxide produced during combustion of a fuel, wherein the old burner has a front plate connected to an exterior housing, and in which the replacement burner system is as defined in claim 1 and the method comprises the steps of:

removing the old burner by disconnecting the front plate from the exterior housing and extracting the old burner form the combustion boiler via an opening in the exterior housing;

removing any existing vanes or air register from within the venturi register; and inserting the replacement burner system, which facilitates reduction in an amount of nitrous oxide produced during combustion of a fuel in the boiler, in the opening in the exterior housing of the combustion boiler and attaching the front plate to the exterior housing.

* * * * *